United States Patent [19]

Bless et al.

[11] Patent Number: 5,036,826

[45] Date of Patent: Aug. 6, 1991

[54] MIX IMPROVEMENT DEVICE FOR INTERNAL COMBUSTION ENGINES

[75] Inventors: Kurt Bless, Pfäffikon; Roland Bucher, Weisslingen, both of Switzerland

[73] Assignee: Nova-Werke AG, Effretikon, Switzerland

[21] Appl. No.: 459,786

[22] PCT Filed: Apr. 4, 1989

[86] PCT No.: PCT/CH89/00068

§ 371 Date: Mar. 29, 1990

§ 102(e) Date: Mar. 29, 1990

[87] PCT Pub. No.: WO89/12163

PCT Pub. Date: Dec. 14, 1989

[30] Foreign Application Priority Data

Jun. 2, 1988 [CH] Switzerland ..... 2118/88

[51] Int. Cl.[5] ..... F02M 17/16; F02M 29/02

[52] U.S. Cl. ..... 123/592; 123/591; 261/88

[58] Field of Search ..... 123/437, 438, 590, 591, 123/592, 472; 261/88, 89; 48/187, 188, 189

[56] References Cited

U.S. PATENT DOCUMENTS

| | | | |
|---|---|---|---|
| 2,791,409 | 5/1957 | Lauder | 261/71 |
| 3,654,909 | 4/1972 | Rollins | 123/592 X |
| 4,044,081 | 8/1977 | Weidlich | 261/51 |
| 4,283,358 | 8/1981 | Diener | 261/88 |
| 4,399,800 | 8/1983 | Weindelmayer | 123/592 |
| 4,422,432 | 12/1983 | Knox, Sr. | 123/592 |
| 4,474,712 | 10/1984 | Diener | 261/88 |
| 4,725,385 | 2/1988 | Diener et al. | 261/88 |
| 4,726,342 | 2/1988 | Diener | 123/438 |
| 4,751,905 | 6/1988 | Bonfiglioli et al. | 123/472 |

FOREIGN PATENT DOCUMENTS

| | | |
|---|---|---|
| 2133134 | 1/1973 | Fed. Rep. of Germany . |
| 1002255 | 1/1953 | France . |

*Primary Examiner*—Willis R. Wolfe

*Attorney, Agent, or Firm*—Tarolli, Sundheim & Covell

[57] ABSTRACT

The device consists of a rotor (4) which is arranged in a suction pipe (1) and rotatably supported. The rotor (4) includes a hollow jacket body (5) on the outer wall of which vanes (2, 3) are arranged. A nozzle holder (26) is guided through the end (10) of the jacket body (5) directed against the air stream, which holder bears the injection nozzle (9) and is connected at the rear end with the fuel feed line (8). The fuel jets (24, 25) coming out of the injection nozzle (9) are directed against the inner wall (20) of the jacket body (5). This forms, at the same time, the jacket surface of the core hollow space (6) which widens toward the open end (11) of the jacket body (5). At the open end (11) is a centrifuge ring (14) with a spray edge (23). The rotor (4) is set in rotation by the stream of air flowing in the direction of the arrows (30, 31), and mixes the fuel centrifuged from the spray edge (23) homogeneously with the air. A measuring probe (28) determines the rpm of the rotor (4) and controls the influx of fuel through a pump to the fuel feed line (8) and thus to the injection nozzle (9).

20 Claims, 4 Drawing Sheets

MIX IMPROVEMENT DEVICE FOR INTERNAL COMBUSTION ENGINES

TECHNICAL FIELD

The invention relates to a mix improvement device for internal combustion engines with central injection, and with a flywheel arranged in the suction pipe and set in rotation by the stream of suction air, which drives a rotor with an injection device for the fuel, and is connected with the latter as well as a fuel feed line led into a hollow space of the rotor.

BACKGROUND ART

In mix preparation and the measuring out of fuel for internal combustion engines, very high requirements are set for both a carburetor and an injection unit as to the content of the exhaust in harmful substances. As we known, high proportions of harmful substances in the exhaust are traced to an insufficient quality of mix, that is, mixing of fuel and combustion air. To obtain a good quality of mix, an optimal mixing of fuel and suction air, a homogeneous distribution of the fuel in the stream of air, and a homogeneous drop size are especially important. Especially in lean engine concepts where one works with a high excess of air, these factors attain still greater importance.

Known means for attaining a good quality of mix are central injection units, such as those described in Kraftfahrttechnische Taschenbuch, 19th edition, VDI Verlag GmbH, Dusseldorf, on Pages 374 and 375. In these devices, an air mixing meter is installed between an air filter and a mix former. In this air amount meter, there may be a damper, a heating wire, or an ultrasonic measuring location. After flowing through the air amount meter, the suction air is led to the mix-forming point. Here, an injection valve is arranged in the suction pipe to which fuel is fed under pressure. The injection valve is equipped with a nozzle, and the fuel is injected through this latter into the suction air stream. In the flow direction of the suction air stream, below the injection valve, is a known choke valve for the regulation of the stream of air or mixture. The feeding of the fuel to the injection valve takes place through a fuel pump. The delivery amount of this pump is determined by a control. The air amount meter serves as sensor for the control.

In addition to the injection valves, spiral scoops, supersonic vibrators, pulsating systems and other devices are sometimes used for improvement of the quality of mix. Injection nozzles for pulsating or air-jacketed systems are technically elaborate in construction and production, and are relatively expensive. The injection valves and nozzles known today cannot assure an ideal thorough mixing of the fuel with the air stream. Moreover, the droplet size of the injected fuel is distributed over a wide spectrum, which in addition to poor mix formation, favors the danger of deposition of fuel on the parts of the mix former. The known difficulties such as the increase of fuel consumption and of harmful substances in the exhaust result from this.

From U.S. Pat. No. 4,044,081 is known a mix-improving device in which an injection valve is combined with a rotary atomizer. A flywheel is arranged in the suction pipe of this device, and namely, before the choke valve in the flow direction of the suction air stream. The flywheel is connected with a rotor and drives the latter. The stream of air flowing through the suction pipe sets the flywheel, and thus the rotor, in rotation. An air line for hot air as well as a pressure line for fuel are introduced into the rotor. In the zone where the two lines discharge into the rotor, one or more eddy chambers are arranged inside in which an intensive mixing of the hot air with the injected fuel should take place. In the peripheral zone of the eddy chamber, nozzle bores are arranged which make possible an outflow of the fuel-air mixture in the direction of the suction air stream. The outflow of the fuel-air mixture through the nozzle bores is promoted by the centrifugal effect of the rotating rotor, while additional openings are also arranged in the suction pipe to obtain an improvement of the thorough mixing of fuel and air. The arrangement of the additional mix improvement devices in the suction pipe makes it clear that even in this device, the same difficulties occur as in the known injection valves without additional rotating mix improvers. The mix formation in the eddy chamber and also the outflow through the nozzle channels are quite difficult to control, and an ideal mix formation can hardly be obtained. The construction design of the device is expensive and hinders the flow of air in the suction pipe.

From German Disclosure No. 2,133,134 is known another carburetor for internal combustion engines with a rotating atomizer. An atomizer pot is set in rotation mechanically from outside. In the center of the atomizing pot is an in-flow opening for fuel and an inset body with a regulating needle. Between the inner wall of the atomizer pot and the inset body is formed a ring-shaped suction channel from which the fuel is sucked into the stream of air. The measuring in of the fuel is difficult here, and very inexact. The additional mechanical rotary drive is expensive and prone to disturbances. This device is intended for a suction carburetor and is not suitable for mixing devices with an injection pump and an injection nozzle. The quality of mix is, in particular, insufficient for the operation of lean engines.

SUMMARY OF THE INVENTION

It is the object of the invention to avoid the disadvantages of the state of the art, and to provide a mix improvement device, and to assure an ideal mix formation with fine droplets and a homogeneous size of droplets. The device should have a simple structure and make possible the use of simple injection nozzles. In addition, the formation of mix should be simplified for different conditions of operation, should make possible the operation of the internal combustion engine as a lean engine, and a reduction of harmful substances in the exhaust should be obtained.

This object is solved according to the invention by the fact that the rotor consists of a jacket body with a free core hollow space and a centrifuge ring which in the suction air stream closes directly against the end of the free core hollow space. The jacket surface of the free hollow core space diverges in the direction of flow of the suction air stream. The core hollow space of the jacket body is at least partly closed against the flow direction of the suction air stream. The fuel feed line is introduced into the jacket body at the closed end of the core hollow space and connected with an injection nozzle. This injection nozzle is arranged in the zone of the lengthwise axis of the free core hollow space, and the spray jets are directed against the diverging jacket surfaces of the core hollow space.

The fuel injected through the injection nozzle into the core hollow space is distributed because of the centrifugal effect of the rotating jacket body over the jacket surface of the core hollow space. As a result of the jacket surface diverging in the flow direction of the suction air stream, the fuel film is driven in the direction of the widened end of the core hollow space. The fuel film on the jacket surface expands further and becomes ever thinner until at the widened end of the core hollow space, it reaches the open end of the jacket body and with it the centrifuge ring. Here the fuel film flows on the periphery of the centrifuge ring, tears away from the centrifuge ring by centrifugal force, and is dissolved into very fine drops. The fuel drops centrifuged out into the suction air stream are smaller than 10 microns and are all of the same size. In this way, small fuel drops are mixed completely with the suction air and torn away with the latter, so that they cannot settle on the wall of the suction pipe. There results a quality of mix not obtained up to now. If the end of the jacket body against which the suction air stream flows is completely closed, the fuel film is advanced to the other end only as a result of the diverging jacket surface. The advancing movement can be additionally supported if air entrance openings are arranged at the closed end of the jacket body.

In another embodiment of the device, the core hollow space is closed at the widened end by a plate transverse to the axis of the rotor. A ring-shaped passage running parallel to the jacket surface of the core hollow space is arranged between this plate and the jacket body. The turbulence of the air stream occurring in the suction pipe may affect even the core hollow space in the jacket body. The plate arranged at the widened end of the core hollow space prevents such disturbances, and facilitates the forming of the fuel film on the jacket surface of the core hollow space. The unhindered flow of the fuel film in the direction of the widened end of the core hollow space is made possible through the ring-shaped passage.

A further improvement as to the forming of a uniform fuel film on the jacket surface of the core hollow space is obtained by the fact that, on the inner wall of the jacket body and before the centrifuge ring, a ring channel is arranged extending around the whole circumference of the core hollow space. This ring channel has a rectangular cross-section and is cut into the inner wall of the jacket body. In another preferred embodiment, the ring channel is formed by a local narrowing of the inner diameter of the core hollow space. In the zone of this ring channel, a thicker film of fluid is formed, and the narrowing of the core hollow space which follows forms a higher flow resistance. Before the fuel film can overcome this resistance, it is completely distributed evenly over the whole circumference of the ring channel, and only then flows on in the direction of the widened end of the core hollow space.

For further dilution of the fluid film, and thus the reduction of the drop size, the continuation of the core hollow space in the zone of the centrifuge ring widens in a cone shape from inside outward. The resultant conical jacket surface forms a ring-shaped spray edge in the zone of intersection with the outer surface of the centrifuge ring The shape of this conical jacket surface allows, in a simple way, adapting the mix improvement device to the different shapes of the suction pipe and the stream of air. One preferred embodiment is distinguished by the fact that a ring-shaped cut-back is formed on the outer surface of the centrifuge ring, and that this runs out into the ring-shaped spray edge. Through this cut-back, the fuel is prevented from running back opposite the direction of the suction air stream along the outer surface of the centrifuge ring. Otherwise, undesirable deposits of fuel might form on the outer surface of the rotor, which would disturb the ideal forming of a mix.

In other developments of the device, the outlet openings of the injection nozzles are so designed that the fuel jets coming out strike entirely against the jacket surface of the core hollow space. This permits operation with simple, cheap nozzles which can be used both in low-pressure and high-pressure systems. Here, unlike the injection valves which inject the fuel directly into the stream of air, lower requirements need be set for the uniformity of fuel jets and drop size. The exact measurement of the drop size and the intensive mixing with the suction air stream takes place only after the fluid film according to the invention has been formed from the spray jets and centrifuged. The device according to the invention allows supporting of the rotor on the closed or on the open end of the jacket body, or even supporting both ends. In case of supporting at the upper end of the jacket body, that is, at the end to which the air stream flows, no further parts after the spray edge on the centrifuge ring need be installed in the suction pipe In this way, the danger of deposition of fuel on the construction parts is still further reduced.

In operation of the device in limit zones, the fuel drops centrifuged out may possibly deposit on the wall of the suction pipe It is well, therefore, to equip the rotor at the lower end with at least one additional rebound ring, and/or to arrange permanently at least one rebound ring in the suction pipe in the flow direction below the rotor. These rebound rings, even in single arrangement, effect an additional atomization of the fuel drops striking, and prevent the deposit of fuel on the suction pipe. For certain designs of the device and rpm ranges, multiple arrangements of rebound rings provide ideal solutions.

In advantageous embodiments of the invention, the rpm of the flywheel is directly proportional to the amount of air sucked in. This is obtained by the fact that the position and shape of the individual vanes are adapted, in a known way, to the shape of the suction pipe and the speed range of the suction air stream. The linear dependence of the rpm of the flywheel on the amount of air makes possible a simple control of the forming of mix. This control is distinguished by the fact that the device has a measuring point for determining the rpm of the rotor. This measuring point is connected through a control device with a fuel pump, and the control device forms with the fuel pump the regulating device for the amount of fuel. In further development, the control device is equipped additionally with sensors for the measurement of the density and temperature of the suction air. The control used corresponds to the known controls already in use for fuel injection systems. Unlike the known devices, the device according to the invention requires no additional metering of air amount since the amount of air can be determined from the rpm of the flywheel present. In addition to the regulating circuit described here, any known additional regulations may be combined with the device and regulation according to the invention. Advantageously, the control device is set over the whole rpm range of the internal combustion engine to a constant ratio of air amount to fuel amount. The desired changing of the fuel-air mix ratio is obtained by feeding additional air. For this purpose, inlet openings for additional air are arranged on the suction pipe after the centrifuge ring in the flow direction of suction air stream. This additional air is taken either from the fresh air filter or from the exhaust channel after the internal combustion engine. The control of the additional amount of air also takes place through the known control device. This control is much simpler than the changing necessary of the fuel pump delivery capacity in other known systems.

The advantages obtained through the invention are mainly to be seen in the fact that a very homogeneous fuel-air mixture with extremely small fuel drops is formed. This ideal mixing makes possible the operation of internal combustion engines with lambda values up to about 1.6. From this results the advantage of a high utilization of fuel, and an extremely low content in pollutants of the exhaust because of the air excess. The forming of a mix under different operating conditions is also greatly simplified, and the whole mix-forming device has fewer parts and some simpler construction parts.

BRIEF DESCRIPTION OF THE DRAWINGS

The invention will be explained in detail below from embodiments with reference to the attached drawings.

DESCRIPTION OF PREFERRED EMBODIMENTS

Figure 1:
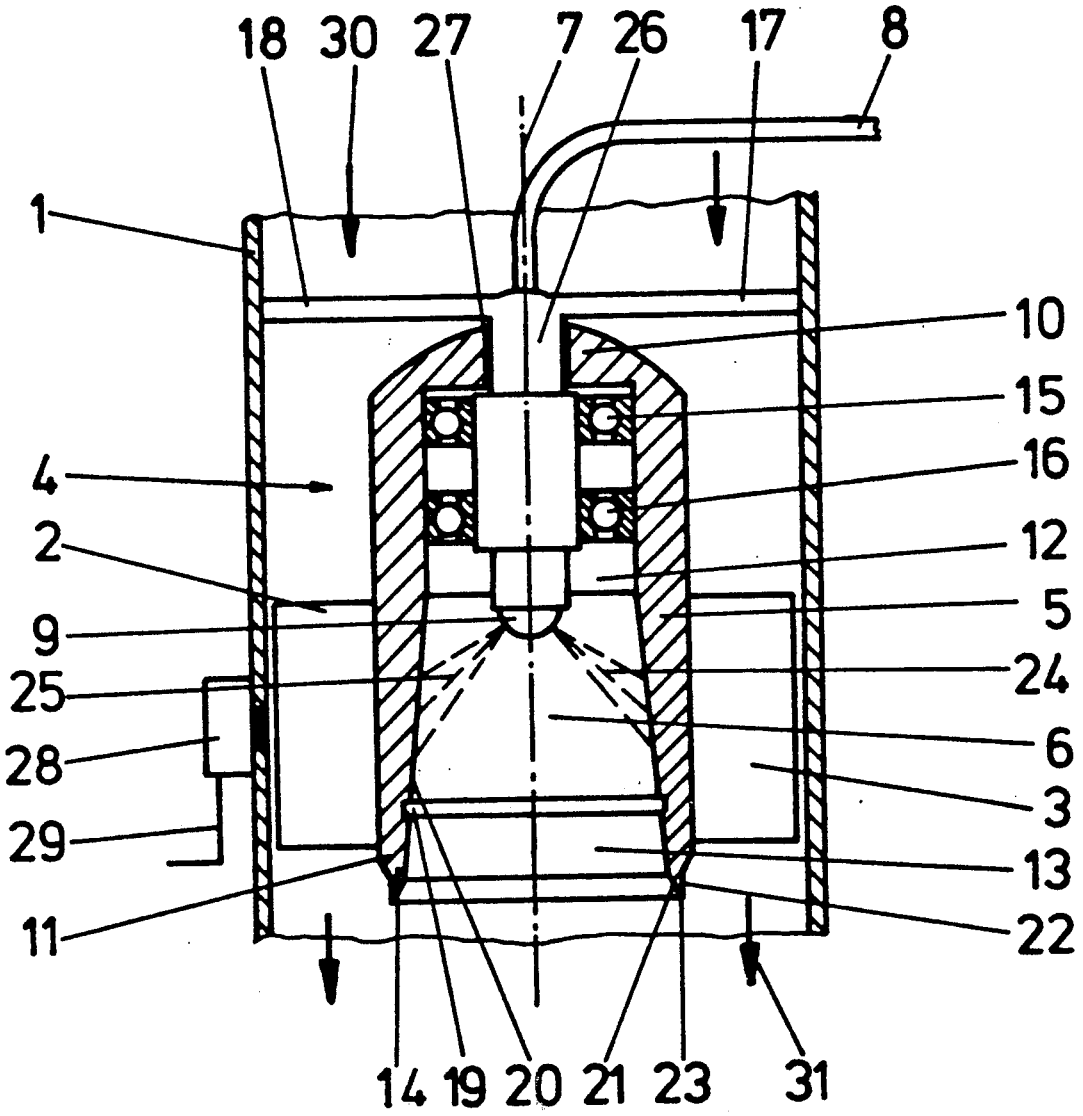
FIG. 1 is a section through a mix-improvement device with a rotor supported at the upper end of a jacket body.

FIG. 1 shows a section from a suction pipe 1 in the zone where the mix of suction air and fuel is formed. In the suction pipe is arranged a rotor 4 which forms with vanes 2 and 3, a flywheel. The rotor 4 consists further of a jacket body 5 which encloses a core hollow space 6. The jacket body 5 is closed at one end 10 and open at the other end 11. The closed end 10 of the jacket body 5 is directed against the flow direction of the suction air stream indicated by the arrow 30. Through the closed end 10 are introduced a fuel feed line 8 and a nozzle holding device 26 into the zone of the core hollow space 6 of the rotor 4. In the zone of passage is arranged a slotted or labyrinth sealing ring 27. This arrangement prevents the suction air from being able to penetrate uncontrolled into the core hollow space 6. The nozzle holder 26 is supported and fixed into its position by radial stays 17, 18 against the suction pipe. On the nozzle holder are arranged also bearings 15, 16 on which the jacket body 5 and the rotor 4 are braced and supported. At the end of the nozzle holder 26 is arranged an injection nozzle 9 which is connected with the fuel feed line 8. This injection nozzle 9 is so designed that fuel jets 24, 25 are formed which arrive on the inner wall 20 of the jacket body 5. This inner wall 20 is identical with the jacket surface 20 of the core hollow space 6. The jacket surface 20 of the core hollow space 6 diverges into the flow direction 30, 31 of the suction air stream, that is, the core hollow space 6 has a narrow end 12 and a widened end 13. The injection nozzle 9 is arranged in the zone of the narrow part 12 of the core hollow space 6. The widened end 13 of the core hollow space 6 forms a part of the open end 11 of the jacket body 5. At the open end 11 of the jacket body 5 is arranged a centrifuge ring 14 which is joined in one piece with the jacket body 5. In the zone of the centrifuge ring 14, the widened end 13 of core hollow space 6 is additionally widened in cone shape from inside outward by which a conical jacket surface 21 is formed. This conical jacket surface 21 intersects with the outer surface 22 of the centrifuge ring and forms a ring-shaped spray edge 23. Before the centrifuge ring, a ring channel 19 is cut in the inner wall of the jacket body 5 and extends around the whole circumference of the core hollow space 6.

A measuring probe 28 is arranged on the suction pipe 1 in the zone of the vanes 2, 3 and is the means by which the rpm of the rotor 4 can be determined. The signals determined on the measuring probe 28 are fed through a line 29 to a control device, not shown. This is a known electronic control device such as that used in similar design, for example, in the known Monojetronic units of the Bosch firm. This control device regulates, depending on the rpm of the rotor 4, the delivery capacity of a fuel pump, also not shown, which delivers fuel through the fuel feed line 8 under pressure into the injection nozzle 9.

Figure 4:
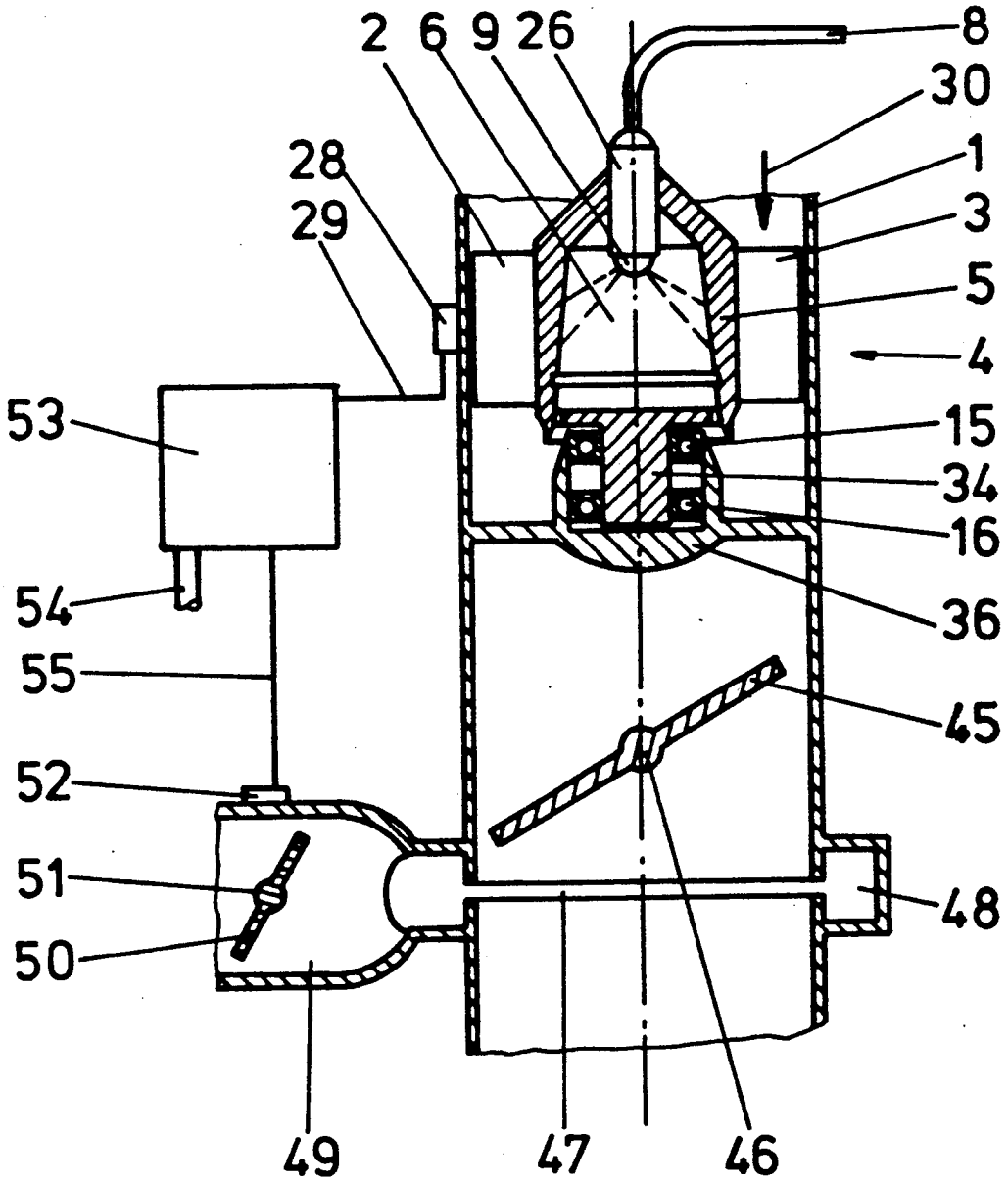
FIG. 4 is a partial section from a suction pipe with a mix improvement device, a choke valve and feeding of additional air arranged after it.

In the operation of the mix-forming device represented, there is a known choke valve after the rotor 4 in the suction pipe 1 in the flow direction of the suction air stream. This is shown in FIG. 4 in the operation of the internal combustion arranged after it. A vacuum results in the suction pipe 1 whereby, with the choke valve opened, a suction air stream results in the direction of the arrows 30, 31. This suction air stream flows through the flywheel with vanes 2, 3 and sets it in rotation. The setting angle and shape of the vanes 2, 3 are so chosen that the rpm of the rotor 4 and the amount of suction air are directly proportional or linear. At the same time through the injection nozzle 9, fuel is sprayed against the inner wall 20 of the jacket body 5. The rotor 4 rotates according to the amount of air with an rpm of up to 100,000 revolutions per minute. Through this rapid rotation, the fuel is evenly distributed along the circumference of the inner wall 20 and forms a uniform fuel film. This fuel film flows from the narrow end 12 of the core hollow space 6 toward the widened end 13. This flow is effected by the diverging jacket surface or inner wall 20 and the rotation of the jacket body 5. In the zone of the ring channel 19, the fuel accumulates until the latter is filled. After this, the fuel film is formed again thin and uniform, and reaches the zone of the conical jacket surface 21. Through this conical widening in the zone of the centrifuge ring 14, the fuel film is additionally thinned, so that it dissolves into drops of less than 10 microns on reaching the spray edge 23. The centrifuged fuel drops are all of practically the same size, and are mixed intensively with the suction air stream, and the fuel-air mixture formed flows in the direction of the arrow 31 toward the internal combustion engine. In this arrangement, the amount of fuel injected at the injection nozzle 9 is regulated dependent on the rpm of the rotor 4 and the position of the choke valve, by means of the control device and the fuel pump. To refine the regulation besides the probe 28 for rpm measurement, still other probes, for example, for measurement of density and temperature of the suction air may be connected in the known way with the control device. The regulation zone of this mix-forming device extends over a range of Lambda values from 0.9 to 1.6.

Figure 2:
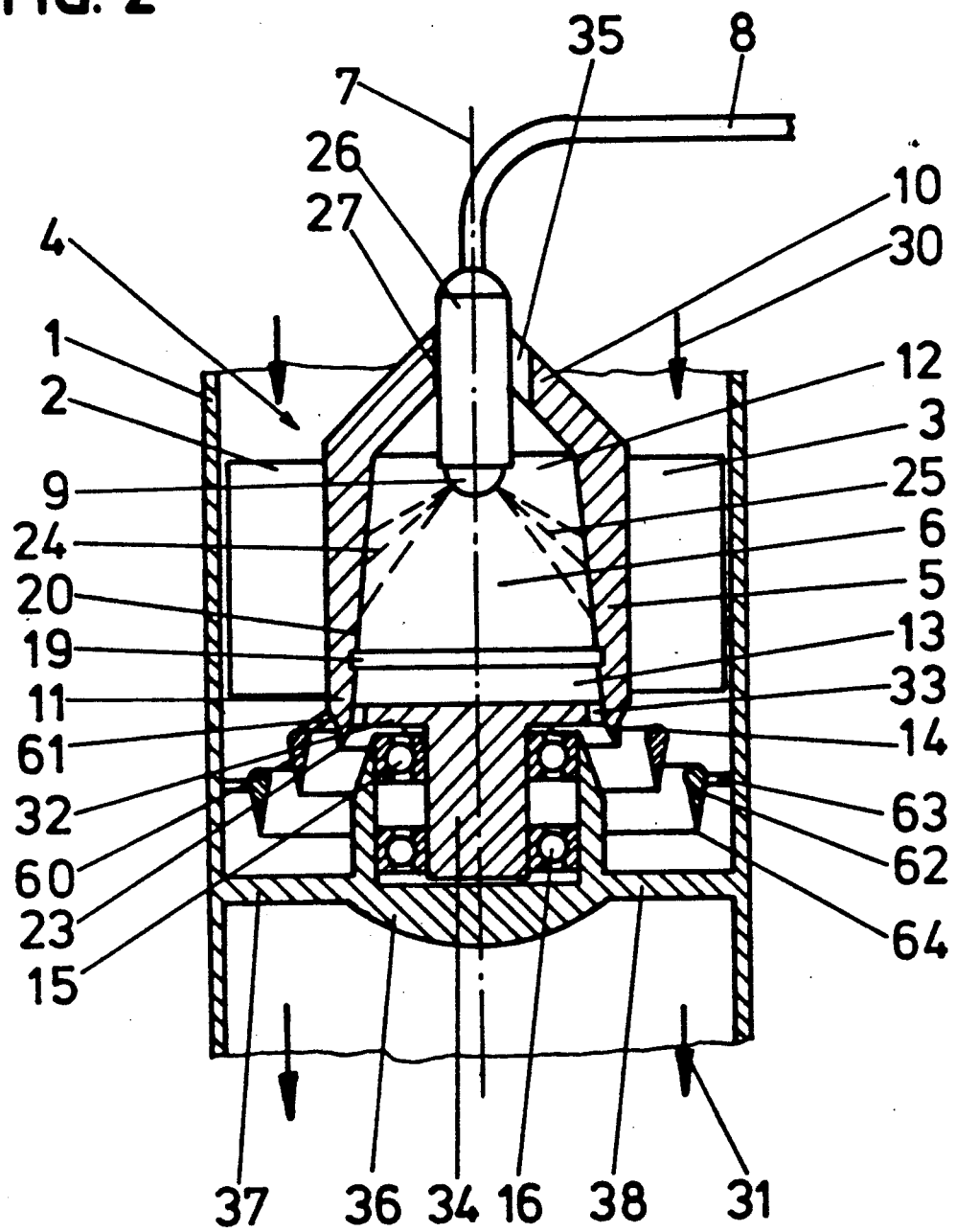
FIG. 2 is a section through a mix-improvement device with a rotor supported at the lower open end of a jacket body.

FIG. 2 shows essentially the same mix improvement or mixing device as FIG. 1. Here, in variance from FIG. 1, the rotor 4 is supported at the open end 11 of the jacket body 5. For this purpose, a plate 32 provided with a bearing pin 34 is arranged at the widened end 13 of the core hollow space 6. On the bearing pin 34 are arranged two bearings 15, 16 which, in turn are supported on the bearing 36. Stays 37, 38 join the bearing 36 with the suction pipe 1 and hold the rotor 4 in the desired position.

A ring-shaped passage 33 running parallel to the jacket surface 20 is arranged between the plate 32 and the inner wall or jacket surface 20 of the jacket body 5. The jacket body 5 is supported by means of several stays against the plate 32. The plate 32 has for its purpose the protection of the core hollow space 6 against disturbances by the suction air stream, for example, the formation of eddies below the rotor. In this design, one or more air channels 35 are arranged in the zone of the passage of the nozzle holder 26 through the closed end 10 of the jacket body 5, which make possible the entrance of the suction air into the core hollow space 6. The air flowing through the channels 35 into the core hollow space 6 supports the fuel flow along the inner wall 20 and additionally damps the disturbances already mentioned, for example, eddy formation. The solution represented in FIG. 2 permits a simple installation and removal of the injection nozzle 9 without having to remove the rotor 4 also. Otherwise, this embodiment has the same advantages and properties, and the mix forming takes place in the same way.

For further improvement of mix formation in the zone of the lower end of the rotor 4, an additional rebound ring 60 is arranged. This rebound ring 60 is connected solidly through stays 61 with the open end 11 of the jacket body 5 and rotates with the latter. Here, the rebound ring 60 is so arranged that the drops centrifuged out by the spray edge 23 strike against the inner surface of the rebound ring 60. The drops striking at very high speed are additionally atomized and carried along by the stream of air.

In the starting of the device or in other not completely controlled rpm ranges of the rotor 4, the mix may deposit on the wall of the suction pipe 1 and form there an undesirable film or larger drops. To prevent the drops from the rotating parts from being centrifuged onto the wall of the suction pipe 1, a stationary rebound ring 62 is installed. This is joined through the stays 63 with the suction pipe 1. The drops of fuel are centrifuged by the rebound ring 60, or if the latter is not installed, by the spray edge 23 against the inner surface of the rebound ring 62. If a fuel film or larger drops are formed under limit conditions on this inner surface, these flow to the edge 64 and are there torn away by the stream of air and atomized. In this way, the forming of fuel deposits on the suction pipe 1 is prevented, and a good forming of mix is assured even in border zones. The rebound rings 60, 62 may be arranged in the device shown, in common or only one in each case.

Figure 3:
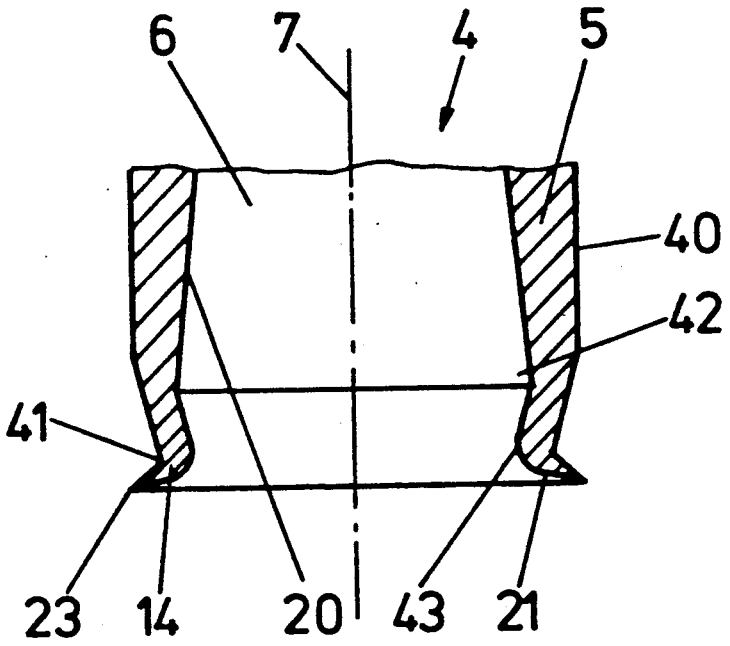
FIG. 3 is a section through the end of the jacket body and a centrifuge ring, in special design.

FIG. 3 shows a special design of the centrifuge ring 14 in which the flowing back of fuel along the outer wall 40 of the jacket body 6 is prevented. For this, on the outer surface of the centrifuge ring 14 is arranged a cut-back 41 which runs out into the ring-shaped spray edge 23. Here also, the core hollow space 6 is conically widened in the zone of the centrifuge ring 14 from inside outward, and forms a conical jacket surface 21. The arrangement of the cut-back 41 and the sharp spray edge 23 prevents, in each case, a flowing back of fuel, and promotes the tearing away of the fuel film at the edge 23 by the stream of air in the form of very fine drops. In FIG. 3 is shown another possibility for the design of a ring channel 42. The inner diameter of the core hollow space 6 is narrowed locally, forming a narrow part 43. In this way, there results after it a pocket-shaped ring channel 42 in which a thicker fuel film is formed than in the other zones of the inner wall 20. This thicker fuel film makes possible, on the one hand, an equalizing of the film over the whole circumference of the inner wall 20, and a more uniform flowing out of the fuel film in the direction of the spray edge 23.

The representation in FIG. 4 shows a complete mix-forming device in simplified design. In the suction pipe 1 is arranged the rotor 4 with the jacket body 5 and the vanes 2, 3. The feeding of fuel into the core hollow space 6 of the jacket body 5 takes place through the injection nozzle 9, the nozzle holder 26, and the fuel feed line 8. The rotor 4 is supported by means of the bearing pin 34 through bearings 15, 16 in the bearing 36. After the rotor in the flow direction of the suction air, there is a choke valve 45 which is connected with a setting device 46. In the flow direction, again below the choke valve an inlet opening 47 in the form of a ring gap is arranged in the suction pipe 1 and is surrounded by a ring-shaped air channel 48. This ring gap 47 forms an inlet opening for additional air which can be suction ed from the ring channel 48 into the suction pipe 1. The ring channel 48 is connected with an air feed line 49 which brings additional air from the fresh air filter or hot exhaust from the exhaust channel to the ring channel 48. In this air feed line 49, there is also a choke valve 50 which is connected with a setting device 51, 52.

Connection lines 54, 55 and 29 lead from an electronic control device to the corresponding setting devices or sensors. The line 29 connects the control device 53 with the sensor 28 for the measuring of the rpm of the rotor 4. The connection line 54 controls the fuel pump and contains other in and out lines for additional control and measuring members. The connection line 55 serves for the switching of the setting members 51, 52 or the choke valve 50 into the air feed line 49.

In the mix-forming device shown in FIG. 4, the injection nozzle 9 is always fed enough fuel so that a mixture is formed with a Lambda number 0.9, that is, a rich mixture. This ratio is kept constant over the whole range of air amount variation or change of rpm of the rotor 4. Because of the high quality of mix which results after the spray edge 23, the mix must not be more strongly enriched, even in extreme situations. In normal operation, additional air is mixed with the mix stream after the rotor 4 through the ring gap 47, in which case ordinary engines may be operated with a Lambda number of about 1.25. This is contrary to the carburetors or injection units known up to now, in which a Lambda number of about 1.05 must be set. In this way, much less carbon monoxide, hydrocarbons and nitrous oxide results in the exhaust. The device according to FIG. 4 is so equipped that enough additional air can be fed that a Lambda number of up to about 1.6 can be reached, with which special so-called lean engines can be operated. Thanks to the homogeneous thorough mixing of the suction air and fuel as well as the small size of fuel drops, even with this high admixture of additional air, there is no deposition of fuel on the walls of the suction pipe.

This invention has been described with reference to preferred embodiments. Modifications and changes may become apparent to one skilled in the art upon reading and understanding this specification. It is intended to cover all such modifications and changes within the scope of the appended claims.

Having described embodiments of the invention, I claim:

1. Mix-improving device for internal combustion engines with central injection, and with a flywheel arranged in a suction pipe and set in rotation by the suction air stream, which drives a rotor with an injection device for the fuel, and is connected with the latter and a fuel feed line guided in a hollow space of the rotor, with the distinction that the rotor (4) consists of a jacket body (5) with a free core hollow space (6) and a centrifuge ring (14) which, in the flow direction of the stream of suction air, adjoins directly the end (11) of the free core hollow space (6), the jacket surface (20) diverges in the flow direction (30) of the stream of suction air, the core hollow space (6) of the jacket body (5) is at least partly closed opposite the flow direction (30) of the stream of suction air, the fuel feed line (8) is introduced at the closed end (10) of the core hollow space (6) and is connected with an injection nozzle (9), the injection nozzle (9) is arranged in the zone of the longitudinal axis (7) of the free core hollow space (6), and the spray jets (24, 25) are directed against the diverging jacket surface (20) of the core hollow space (6).

2. Mix-improving device according to claim 1, with the distinction that the core hollow space (6) is closed at the widened end (13) by a plate (32) standing transverse to the rotor axis (7), and a ring-shaped passage (33) running parallel to the jacket surface (20) of the core hollow space (6) is arranged between the plate (32) and the jacket body (5).

3. Mix-improving device according to claim 1 with the distinction that a ring channel (19) extending over the whole circumference of the core hollow space (6) is arranged against the inner wall (20) of the jacket body (5) and before the centrifuge ring (14).

4. Mix-improving device according to claim 3, with the distinction that the ring channel (19) has a rectangular cross-section, and is cut into the inner wall (20) of the jacket body (5).

5. Mix-improving device according to claim 3, with the distinction that the ring channel (19) is formed by a local narrowing (43) of the inner diameter of the core hollow space (6).

6. Mix-improving device according to claim 1 with the distinction that the continuation of the core hollow space (6) is widened in a cone shape in the zone of the centrifuge ring (14) from inside outward, and the resultant conical jacket surface (21) in the zone of intersection with the outer surface (22) of the centrifuge ring (14) forms a ring-shaped spray edge (23).

7. Mix-improving device according to claim 1 with the distinction that a ring-shaped cut back (41) is formed against the outer surface (22) of the centrifuge ring (14) and runs out into the ring-shaped spray edge (23).

8. Mix-improving device according to claim 1 with the distinction that the outlet openings of the injection nozzle (9) are so designed that the fuel jets (24, 25) coming out strike entirely against the jacket surface (20) of the core hollow space (6) in the rotor (4).

9. Mix-improving device according to claim 1 with the distinction that the rotor (4) is supported on the upper end (10), at least partly closed, of the jacket body (5), and the bearings (15, 16) are supported against the fuel feed line (8) and/or the injection nozzle (9, 26).

10. Mix-improving device according to claim 1 with the distinction that the rotor (4) is supported at the open end (11) of the jacket body (5) and after the centrifuge ring (14), and the bearing (36) is supported through radial stays (37, 38) against the suction pipe (1).

11. Mix-improving device according to claim 1 with the distinction that the rotor (4) is supported in the flow direction (30) of the suction air stream before the injection nozzle (9) and after the centrifuge ring (14).

12. Mix-improving device according to claim 1 with the distinction that the rotor (4), at the lower end, is equipped with at least one additional rebound ring (60).

13. Mix-improving device according to claim 1 with the distinction that at least one rebound ring (62) is permanently arranged in the suction pipe 1 below the rotor (4) in the flow direction.

14. Mix-improving device according to claim 1 with the distinction that the rpm of the flywheel with vanes (2, 3) is directly proportional to the amount of air suctioned.

15. Mix-improving device according to claim 1 with the distinction that the device has a measuring probe (28) for the measurement of the rpm of the rotor (4), the measuring probe (28) is connected through a control device (53) with a fuel pump, and the control device (53) forms with the fuel pump the regulating device for the amount of fuel.

16. Mix-improving device according to claim 15, with the distinction that the control device (53) is additionally equipped with sensors for measurement of the density and the temperature of the suction air.

17. Mix-improving device according to claim 15, with the distinction that the control device (53) is set to a constant ratio of air amount to fuel amount over the whole rpm range of the internal combustion engine.

18. Mix-improving device according to claim 1 with the distinction that inlet openings (47) for additional air are arranged in the suction pipe (1) after the centrifuge ring (14) in the flow direction (30) of the suction air stream.

19. Mix-improving device according to claim 18, with the distinction that the inlet openings (47) for the additional air are connected through an air channel (48, 49) with the fresh air filter.

20. Mix-improving device according to claim 18, with the distinction that the inlet openings (47) for the additional air are connected through an air channel (48, 49) with the exhaust channel after the internal combustion engine.

* * * * *